United States Patent [19]

Etemad et al.

[11] Patent Number: 5,065,550

[45] Date of Patent: Nov. 19, 1991

[54] LAPPING OF INVOLUTE SPIRAL SCROLL ELEMENT

[75] Inventors: Shahrokh Etemad, Stratford, Conn.; Howard H. Fraser, Jr., Lafayette, N.Y.

[73] Assignee: Carrier Corporation, Syracuse, N.Y.

[21] Appl. No.: 457,141

[22] Filed: Dec. 26, 1989

[51] Int. Cl.[5] ..... B24B 1/00

[52] U.S. Cl. ..... 51/317; 51/119; 51/120

[58] Field of Search ..... 51/317, 119, 120, 129, 51/131.1, 131.2, 131.3, 131.4, 26, 209 S, 71

[56] References Cited

U.S. PATENT DOCUMENTS 4,502,252 3/1985 Iwabuchi ..... 51/131.4

FOREIGN PATENT DOCUMENTS 57-96762 6/1982 Japan ..... 51/71

*Primary Examiner*—M. Rachuba

[57] ABSTRACT

The scroll elements of a scroll-type compressor are treated employing a lapping tool to achieve increased flatness of the base surface and increased smoothness of the side walls of the involute wrap. This reduces flank leakage, tip leakage, and thrust friction losses. The lapping device that is placed against the scroll element has a radially extending base and a generally spiral wrap, the wrap generally matching that of the scroll element workpiece. The lapping device wrap has axially erect walls and a radially flat tip surface. After engaging the scroll element work piece, the lapping device is moved relative to the scroll element in an orbiting motion. A suitable lapping compound is introduced at least between the lapping device wrap tip surface and the base surface of the scroll element, and, if desired, also between the side walls of the lapping device wrap and the side walls of the scroll element wrap. The lapping compound can be introduced directly or in a gas flow.

6 Claims, 1 Drawing Sheet

LAPPING OF INVOLUTE SPIRAL SCROLL ELEMENT

BACKGROUND OF THE INVENTION

This invention relates to scroll-type rotating machines, such as scroll compressors as used in air conditioning and refrigeration. The invention is more particularly directed to the achievement of superior finishing and surface smoothness in surfaces of moving parts that mate together in a scroll machine.

Scroll type rotary machines are advantageously used to compress or pump a gas. These machines typically have two scroll members that face each other, each formed of a generally circular base plate and a spiral or involute wrap that is generally erect with respect to the base. That is, the wrap has side walls that are parallel to the axis of the scroll member. The scroll members maintain a fixed azimuth relative to one another, but are radially offset so that one can revolve about the other in an orbiting fashion. Relative orbiting motion is typically achieved by holding one scroll member fixed in a housing, and orbiting the other by rotating an eccentric shaft while holding the orbiting scroll member with an anti-rotation device, such as an Oldham's ring. Orbiting motion can also be achieved by rotating both scroll members on parallel, offset axes.

The walls of the involute wraps define crescent-shaped volumes which become smaller and smaller, and which move from the outside to the center of the mating scrolls with motion of the orbiting scroll element. A compressor fluid, such as a refrigerant gas, can be introduced at the periphery of the spiral wraps, and this fluid is compressed as it is moved under the orbiting motion of the device. The compressed fluid is then discharged at center. By introducing a compressed fluid into the center of the device and permitting it to expand, the scroll machine can be used as a motor.

In order to achieve good efficiency characteristics, mating surfaces of the scroll elements must be as regular and smooth as possible, both to minimize frictional losses and to minimize gas leakage from the crescent-shaped volumes. Flank leakage can occur across the axial line where the walls of the two wraps are tangent, and tip leakage can occur where the tip of one scroll wrap contacts the flat base surface of the mating scroll element. Generally, tip leakage is a greater source of loss and inefficiency than flank leakage. Also, imperfections in flatness of the base surface of the scroll elements are responsible for thrust friction losses.

Machining a scroll element so that the base wall is flat and the walls of the wrap are axially erect spirals is extremely difficult to accomplish. The presence of the wrap itself prevents standard grinding and machining techniques from being employed for this end, because the operative surfaces to be finished are recessed below the tip of the scroll wrap.

There has been no simple technique proposed previously to finish and flatten the scroll element surfaces so as to minimize leakage and frictional losses.

OBJECTS AND SUMMARY OF THE INVENTION

Accordingly, it is an object of this invention to provide a technique for increasing the efficiency of scroll compressors and other scroll type rotating machines.

It is another object of this invention to provide scroll elements with increased flatness on the base surface, and to provide the wrap walls with increased smoothness.

In accordance with an aspect of the invention, the base and the wrap of a scroll element are finished by lapping them with a lapping device. The lapping device has a flat base and a generally spiral or involute wrap that mates with the wrap of the workpiece scroll element. The wrap of the lapping device has axially erect walls and a radially flat tip surface that faces against the base surface of the scroll element workpiece.

The scroll element and the lapping devices are moved in an orbiting fashion with respect to one another, and a suitable lapping compound is introduced between the tip of the lapping device scroll and the base surface of the scroll element. Lapping compound can also be introduced between the side walls of the lapping device wrap and the side walls of the scroll element wrap. The eccentricity of rotation is controlled so that either the base surface only is lapped or both the base and wrap wall surfaces are lapped, as required.

Preferably, the lapping device has a significantly thicker wrap than a normal scroll element. This reduces the velocity of motion required for the lapping process. The lapping element is favorably made of a suitably hardened material, such as hardened steel, to avoid wear.

The lapping compound can be introduced directly into the crescent shaped pockets, as a flow of gas and particles of the compound through the interface of the lapping device and scroll element workpiece.

The principles of this invention can also be practiced by using the two facing scroll elements, i.e., the fixed and orbiting scroll elements, that are intended for the same compressor to lap each other.

The above and many other objects, features, and advantages of this invention will be more fully appreciated from the ensuing description of a preferred embodiment of this invention, which should be read in connection with the accompanying Drawing.

DETAILED DESCRIPTION OF A PREFERRED EMBODIMENT

Figure 1:
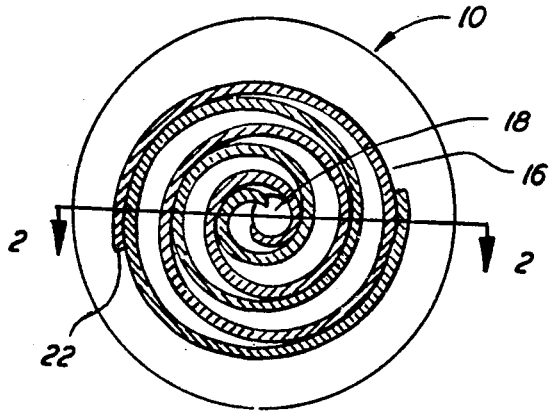
FIG. 1 is a cross section of a pair of scroll elements of a scroll compressor as viewed at 1—1 of FIG. 2
Figure 2:
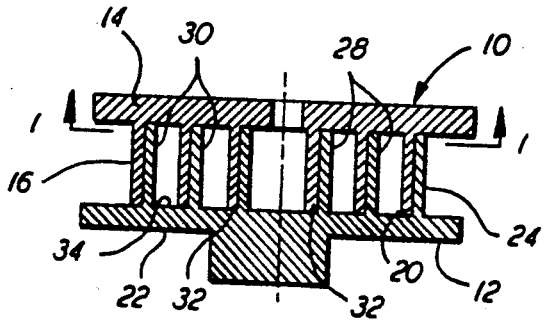
FIG. 2 is an axial section of the scroll elements as viewed at 2—2 of FIG. 1.

With reference to the Drawing, and initially to FIGS. 1 and 2 thereof, a scroll-type device for a scroll compressor or other rotary scroll machine has an upper, fixed scroll element 10 and a lower, orbiting scroll element 12. The lower scroll element 12 is driven by a rotary eccentric drive, but is held in a fixed azimuthal orientation by an anti-rotation mechanism, such as an Oldham's ring. The upper scroll element 10 has a flat, circular base member, and a spiral or involute wrap, the wrap spirals about an axis of the scroll element 10 and extends from the periphery of the element 10 to an outlet 18 at the center. The upper and lower scroll elements 10 and 12 engage one another so that a tip surface 20 of the fixed scroll wrap 16 contact a flat based surface 22 of the lower orbiting scroll element 12. The orbiting scroll element 12 also has an involute wrap 24 that conforms with the wrap 16, and extends from the periphery of the element 12 to its center. The wrap 24 spirals around the axis of the orbiting scroll element 12. The wrap 24 has an inner side wall 28 that engages the outside wall of the fixed element wrap 16, and an outer side wall 30 that engages the inside wall of the fixed scroll element wrap 16. The wrap 24 has a tip surface 32 that engages a flat base surface 34 of the base 14 of the fixed scroll element 10.

Figure 3:
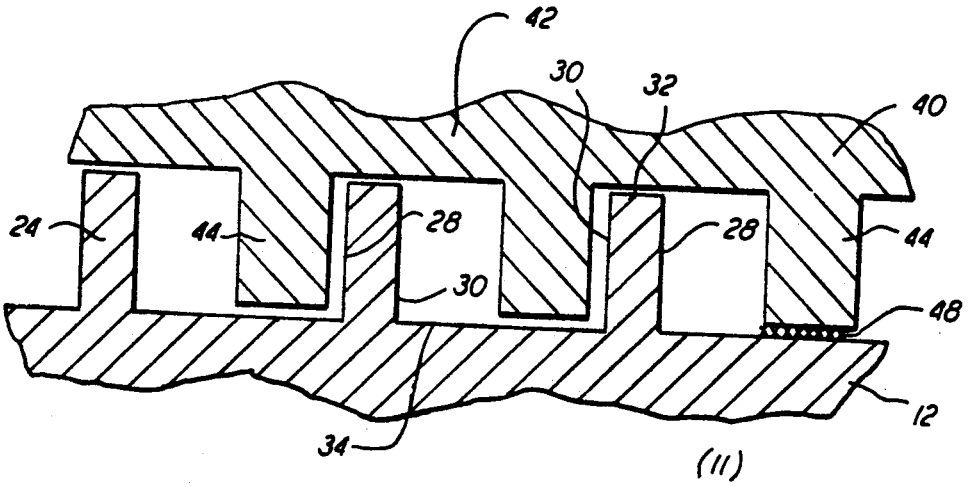
FIG. 3 is a partial cross section showing a lapping element and a workpiece scroll element, for explaining the technique of this invention.

A lapping tool 40, as shown in part in FIG. 3, has a base portion 42, which can be in the form of a disk, and a wrap 44 which spirals around the axis of the base portion 42. Here, the lapping tool 40 is intended for finishing the operative surfaces of the orbiting scroll 12. The wrap 44 conforms with the spiral of the wrap 24. As shown, the lapping tool wrap 44 is substantially thicker in the radial direction than the involute wrap 24 of the scroll element 12. The wrap 44 is preferably formed of a suitable hardened material such as hardened steel, with at least exterior surfaces being suitably treated so that the lapping tool 40 has a long useful life.

In operation, the lapping tool 40 and the workpiece scroll element 12 engage one another and undergo orbital motion relative one another. That is, one or the other of the element 12 and tool 40 revolves about the axis of the other, but the element 12 and tool 40 are held in a fixed azimuthal relationship with each other. The eccentricity of the orbiting motion is controlled for proper lapping operation. A lapping compound 48 is introduced at least between a tip surface 46 of the wrap 44 and the base surface 14 of the scroll element 12. The lapping compound 48 can also be introduced, if desired, between the lapping tool wrap 44 and the side walls 28 and 30 of the scroll element wrap 24. The eccentricity of orbital motion can be controlled for precise lapping of these surfaces 28 and 30. The enlarged area of the tip surface 46, owing to the large relative thickness of the lapping tool wrap 44, creates a wider contact area with the workpiece scroll element base 14. This permits the relative velocity of motion to be kept low.

A lapping tool for lapping the upper fixed scroll element 10 is similar to the lapping tool 40, except the wrap spiral direction is reversed to conform with the wrap 16.

Lapping compound can be introduced directly into the crescent-shaped pockets or volumes that are formed between the wrap of the workpiece scroll element and the wrap of the lapping device. Then the compound is distributed by the orbiting motion of the scroll element and lapping device. Alternatively, lapping compound can be introduced with a flow of gas combined with particles of the lapping compound through the interface of the lapping tool 40 and the scroll element workpiece.

While this invention has been described in detail with respect to a preferred embodiment, it should be understood that the invention is not limited to that precise embodiment. Rather, many modifications and variations would present themselves to those of skill in the art without departing from the scope and spirit of this invention as defined in the appended claims.

What is claimed is:

1. A method of finishing a scroll element for a scroll rotary machine in which the scroll element has a base with a radially flat surface and a generally spiral wrap about an axis of the element with side walls that are axially erect comprising the steps of:

placing against said scroll element a lapping device that has a radially extending base and a generally spiral wrap about an axis of the lapping device, the generally spiral wrap matching the wrap of the scroll element, but wherein said lapping element wrap is significantly and uniformly thicker radially than the scroll element wrap, the wrap of the lapping device having axially erect walls and a radially flat tip surface that faces against the base flat surface of the scroll element; said scroll element wrap and lapping device wrap defining a series of crescent shaped volumes that diminish in size from an outer edge to the axis of the scroll element and lapping device;

moving the scroll element and the lapping device against one another in an orbiting motion in which the axes of the device and scroll element revolve about one another but the device and scroll element maintain a constant azimuthal orientation relative to one another; and flowing a suitable lapping compound at least between the tip surface of the lapping device and the base surface of the scroll element and between the lapping device wrap and the side walls of the scroll element wrap while the lapping device and scroll element are being moved in said orbiting motion in contact with one another, by introducing said lapping compound directly into said crescent shaped volumes and distributing the compound by orbiting action of the scroll element and the lapping device, for lapping at least the base flat surface and side walls of the scroll element.

2. The method of claim 1 wherein said lapping element is formed of a hardened steel.

3. The method of claim 1 wherein said lapping compound is supplied by providing a flow of a fluid carrying said lapping compound into the engaging surfaces of the lapping device and the scroll element.

4. The method of claim 1 also comprising controlling eccentricity of the orbiting motion of said scroll element and lapping device to lap the side walls of the scroll device wrap.

5. A method of finishing a scroll element for a scroll compressor in which the scroll element has a base with a radially flat surface and a generally spiral wrap about an axis of the element with side walls that are axially erect, comprising the steps of:

placing against said scroll element a lapping device that has a radially extending base and a generally spiral wrap about an axis of the lapping device, the generally spiral wrap matching the spiral wrap of the scroll element, the wrap of the lapping device having a radially flat tip surface that faces against the base flat surface of the scroll element, said scroll element wrap and lapping device wrap defining a series of crescent shaped volumes that diminish in size as they approach the axis during orbiting motion of the scroll element and lapping device;

producing relative orbiting motion between the scroll element and the lapping device in which the device and scroll element maintain a constant azimuthal orientation relative to one another; and supplying a suitable lapping compound between the tip surface of the lapping device wrap and the base surface of the scroll element while the lapping device and scroll element are being moved in said orbiting motion in contact with one another, including introducing said lapping compound directly into said crescent shaped volumes and distributing the compound by orbiting action of the scroll element and lapping device.

6. The method of claim 1 wherein said scroll machine has a second scroll element having a base with a radially flat surface and a generally spiral wrap similar to that of the first-mentioned element but in which the direction of the spiral wrap is reversed; further comprising placing against the second scroll element a second lapping device having a generally spiral wrap matching the wrap of the second scroll element but which is substantially thicker radially than the second scroll element wrap, the wrap of the second lapping device having axially erect walls and a radially flat tip surface that faces against the base flat surface of the second scroll element; moving the second scroll element and second lapping device against one another in an orbiting motion in which the axes of the device and scroll element maintain a constant azimuthal orientation relative to one another; and flowing a suitable lapping compound between the tip surface of the second lapping device and the base surface of the scroll element and between the second lapping device wrap and the side walls of the second scroll wrap while the lapping device and scroll element are being moved in said orbiting motion in contact with one another.

* * * * *